US011398694B2

(12) United States Patent
Henry et al.

(10) Patent No.: US 11,398,694 B2
(45) Date of Patent: Jul. 26, 2022

(54) FLEX JUMPER ASSEMBLY FOR A PLUG CONNECTOR ASSEMBLY

(71) Applicant: TE Connectivity Services GmbH, Schaffhausen (CH)

(72) Inventors: Randall Robert Henry, Lebanon, PA (US); Linda Ellen Shields, Mechanicsburg, PA (US); Michael John Phillips, Camp Hill, PA (US); Brandon Michael Matthews, McAlisterville, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 17/036,230

(22) Filed: Sep. 29, 2020

(65) Prior Publication Data

US 2022/0102888 A1 Mar. 31, 2022

(51) Int. Cl.
*H01R 12/79* (2011.01)
*H01R 13/627* (2006.01)
*H01R 13/424* (2006.01)

(52) U.S. Cl.
CPC ..... *H01R 12/79* (2013.01); *H01R 13/424* (2013.01); *H01R 13/627* (2013.01)

(58) Field of Classification Search
CPC ..... H01R 12/79; H01R 12/77; H01R 12/78; H01R 12/75; H01R 12/73; H01R 12/72; H01R 12/71; H01R 12/7017; H01R 13/424; H01R 13/627; H01R 13/62
USPC ..... 439/328
See application file for complete search history.

(56) References Cited

U.S. PATENT DOCUMENTS 4,658,375 A * 4/1987 Onogi ..... H05K 7/1478 361/679.41
5,336,095 A 8/1994 Walburn et al.
6,139,360 A * 10/2000 Hayashi ..... H05K 7/1441 439/502
6,431,876 B1 8/2002 Svenkeson et al.
6,520,789 B2 2/2003 Daugherty, Jr. et al.
6,572,403 B2 * 6/2003 Reimund ..... H01R 25/006 439/507
6,592,380 B2 * 7/2003 Miyazawa ..... H01R 12/592 439/67
6,743,045 B1 * 6/2004 Hayashi ..... H01R 13/33 439/495

(Continued)

FOREIGN PATENT DOCUMENTS

EP 1978600 B1 10/2018
JP H05299807 A 11/1993

*Primary Examiner* — Harshad C Patel

(57) ABSTRACT

A plug connector assembly includes first and second plug connectors each including a plug housing having a top wall, a bottom wall, a first side wall, and a second side wall forming a cavity. The side walls include a housing securing feature. The plug connector assembly includes a flex jumper assembly coupled between the plug connectors having a flex circuit extending between first and second paddle cards. The paddle cards each include a rigid substrate having a mating end and side edges extending to a flex circuit end. The rigid substrate includes a plug connector securing feature at the side edge engaging the housing securing feature to retain the paddle card in the corresponding plug housing. The flex circuit is flexible between the first and second paddle cards.

20 Claims, 6 Drawing Sheets

(56) References Cited

U.S. PATENT DOCUMENTS

| | | | | |
|---|---|---|---|---|
| 6,971,887 | B1 * | 12/2005 | Trobough | H05K 7/1092 439/71 |
| 7,148,428 | B2 * | 12/2006 | Meier | G06F 1/184 174/260 |
| 7,168,961 | B2 * | 1/2007 | Hsieh | H01R 12/725 439/74 |
| 7,189,926 | B2 * | 3/2007 | Hung | H05K 1/118 174/117 F |
| 7,248,481 | B2 * | 7/2007 | Trobough | H05K 7/1061 361/785 |
| 7,425,135 | B2 | 9/2008 | Liu et al. | |
| 7,517,228 | B2 * | 4/2009 | Baskaran | H05K 1/147 439/67 |
| 8,432,705 | B2 * | 4/2013 | Ge | G06F 1/185 361/785 |
| 9,113,551 | B2 | 8/2015 | McClatchie et al. | |
| 9,252,521 | B1 * | 2/2016 | Beaman | H01R 13/2442 |
| 9,478,885 | B2 * | 10/2016 | MacDougall | H01R 12/73 |
| 10,903,594 | B2 * | 1/2021 | Herring | H01R 12/78 |
| 11,024,995 | B2 * | 6/2021 | Chien | H01R 12/716 |
| 2009/0023330 | A1 * | 1/2009 | Stoner | H01R 12/52 439/493 |
| 2014/0217571 | A1 * | 8/2014 | Ganesan | H01B 7/04 257/693 |

* cited by examiner

FLEX JUMPER ASSEMBLY FOR A PLUG CONNECTOR ASSEMBLY

BACKGROUND OF THE INVENTION

The subject matter herein relates generally to electrical connector systems.

Components of electrical connector systems are interconnected, such as by cable assemblies. For example, cable assemblies may be used to electrically connect circuit boards through electrical connectors. In some electrical connector systems, the cables provide electrical shielding for signal conductors along the lengths of the cables between the electrical connectors to enhance signal performance, such as by reducing crosstalk. However, termination of cables to paddle cards of electrical connectors is an expensive manufacturing process. For short range solutions, the benefit of the shielding provided by the cables may not justify the additional manufacturing costs associated with the termination of the cables to the paddle cards.

A need remains for a cost effective and reliable solution for short range electrical connection of electrical connector system components.

BRIEF DESCRIPTION OF THE INVENTION

In one embodiment, a plug connector assembly is provided. The plug connector assembly includes a first plug connector including a first plug housing having a top wall, a bottom wall, a first side wall, and a second side wall forming a first cavity. The first and second side walls of the first plug housing include a first housing securing feature. The plug connector assembly includes a second plug connector including a second plug housing having a top wall, a bottom wall, a first side wall, and a second side wall forming a second cavity. The first and second side walls of the second plug housing include a second housing securing feature. The plug connector assembly includes a flex jumper assembly coupled between the first plug connector and the second plug connector. The flex jumper assembly includes a first paddle card, a second paddle card and a flex circuit extending between the first paddle card and the second paddle card. The first paddle card has a first rigid substrate including a first mating end and a side edge extending from the first mating end to a first flex circuit end. The first paddle card includes first contacts at the first mating end. The first rigid substrate includes a first plug connector securing feature at the side edge. The first paddle card is received in the first cavity. The first plug connector secures feature engaging the first housing securing feature to retain the first paddle card in the first plug housing. The second paddle card has a second rigid substrate including a second mating end and a side edge extending from the second mating end to a second flex circuit end. The second paddle card includes second contacts at the second mating end. The second rigid substrate includes a second plug connector securing feature at the side edge. The second paddle card is received in the second cavity. The second plug connector securing feature engages the second housing securing feature to retain the second paddle card in the second plug housing. The flex circuit extends between the first flex circuit end and the second flex circuit end. The flex circuit is flexible between the first and second paddle cards.

In another embodiment, an electrical connector system is provided. The electrical connector system includes a first receptacle connector having a first receptacle connector housing mounted to a first host circuit board. The first receptacle connector housing has a card slot. The first receptacle connector includes first receptacle contacts held by the first receptacle connector housing at the card slot. The first receptacle contacts is electrically connected to the first host circuit board. The electrical connector system includes a second receptacle connector having a second receptacle connector housing mounted to a second host circuit board. The second receptacle connector housing has a card slot. The second receptacle connector includes second receptacle contacts held by the second receptacle connector housing at the card slot. The second receptacle contacts are electrically connected to the second host circuit board. The electrical connector system includes a plug connector assembly coupled between the first and second receptacle connectors. The plug connector assembly includes a first plug connector, a second plug connector, and a flex jumper assembly coupled between the first plug connector and the second plug connector. The first plug connector includes a first plug housing coupled to the first receptacle connector housing. The first plug housing has a top wall, a bottom wall, a first side wall, and a second side wall forming a first cavity. The first and second side walls of the first plug housing include a first housing securing feature. The second plug connector includes a second plug housing coupled to the second receptacle connector housing. The second plug housing has a top wall, a bottom wall, a first side wall, and a second side wall forming a second cavity. The first and second side walls of the second plug housing include a second housing securing feature. The flex jumper assembly includes a first paddle card, a second paddle card and a flex circuit extending between the first paddle card and the second paddle card. The first paddle card has a first rigid substrate including a first mating end and a side edge extending from the first mating end to a first flex circuit end. The first mating end is received in the card slot of the first receptacle connector housing. The first paddle card includes first contacts at the first mating end. The first rigid substrate includes a first plug connector securing feature at the side edge. The first paddle card is received in the first cavity. The first plug connector securing feature engages the first housing securing feature to retain the first paddle card in the first plug housing. The second paddle card has a second rigid substrate including a second mating end and a side edge extending from the second mating end to a second flex circuit end. The second mating end is received in the card slot of the second receptacle connector housing. The second paddle card includes second contacts at the second mating end. The second rigid substrate includes a second plug connector securing feature at the side edge. The second paddle card is received in the second cavity. The second plug connector securing feature engages the second housing securing feature to retain the second paddle card in the second plug housing. The flex circuit extends between the first flex circuit end and the second flex circuit end. The flex circuit is flexible between the first and second paddle cards.

In another embodiment, a flex jumper assembly is provided. The flex jumper assembly includes a first paddle card having a first rigid substrate including an upper surface and a lower surface. The first paddle card has a first mating end. The first paddle card includes side edges extending from the first mating end to a first flex circuit end opposite the first mating end. The first paddle card includes upper contacts on the upper surface at the first mating end. The first paddle card includes lower contacts on the lower surface at the first mating end. The first rigid substrate includes securing features at the side edges configured to engage a first plug housing to retain the first paddle card in the first plug housing. The flex jumper assembly includes a second paddle card having a second rigid substrate including an upper surface and a lower surface. The second paddle card has a second mating end. The second paddle card includes side edges extending from the second mating end to a second flex circuit end opposite the second mating end. The second paddle card includes upper contacts on the upper surface at the second mating end. The second paddle card includes lower contacts on the lower surface at the second mating end. The second rigid substrate includes securing features at the side edges configured to engage a second plug housing to retain the second paddle card in the second plug housing. The flex jumper assembly includes a flex circuit extending between the first flex circuit end of the first paddle card and the second flex circuit end of the second paddle card. The flex circuit is flexible between the first and second paddle cards.

DETAILED DESCRIPTION OF THE INVENTION

Figure 1:
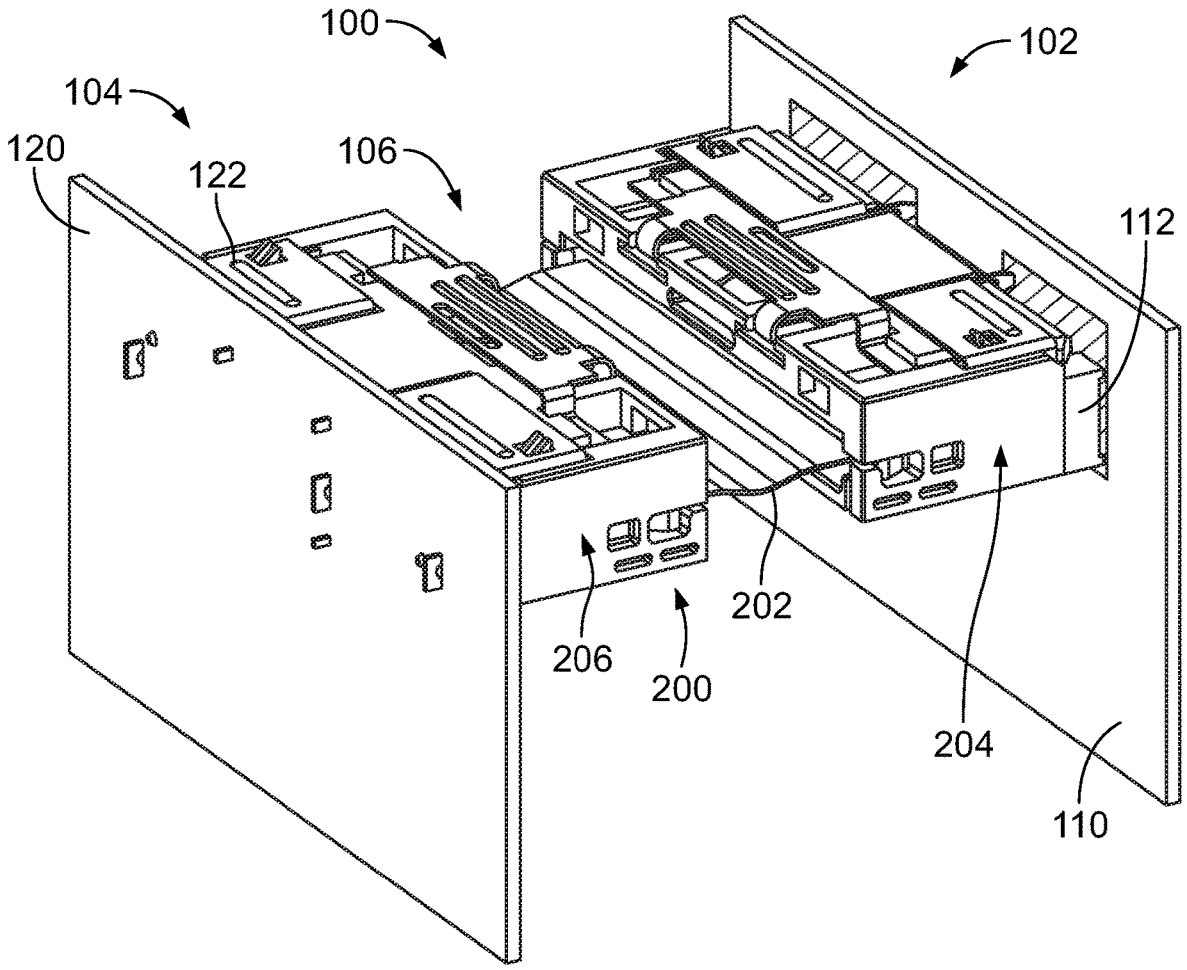
FIG. 1 illustrates an electrical connector system including a flex jumper assembly in accordance with an exemplary embodiment.

FIG. 1 illustrates an electrical connector system 100 in accordance with an exemplary embodiment. The electrical connector system 100 includes a first electrical component 102 and a second electrical component 104. A flex jumper assembly 200 is used to electrically connect the first and second electrical components 102, 104. The flex jumper assembly 200 includes a flex circuit 202 between a first plug connector 204 and a second plug connector 206. The first plug connector 204 is coupled to the first electrical component 102 and the second plug connector 206 is coupled to the second electrical component 104. The flex circuit 202 allows relative movement between the first plug connector 204 and the second plug connector 206, such as for alignment and mating of the plug connectors 204, 206 with the electrical components 102, 104. The flex circuit 202 accommodates for misalignment of the plug connectors 204, 206 relative to each other when mated to the electrical components 102, 104. The flex circuit 202 spans the distance between the connectors 204, 206, which may be less than 200 mm in various embodiments, such as less than 150 mm in an exemplary embodiment.

In an exemplary embodiment, the first electrical component 102 includes a first circuit board 110 and a first receptacle connector 112 mounted to the first circuit board 110. The second electrical component 104 includes a second circuit board 120 and a second receptacle connector 122 mounted to the second circuit board 120. The first and second receptacle connectors 112, 122 oppose each other across a gap or space 106 between the first and second circuit boards 110, 120. In various embodiments, the first and second circuit boards 110, 120 may be oriented parallel to and spaced apart from each other. Other orientations are possible in alternative embodiments. Optionally, the first and second receptacle connectors 112, 122 may be identical to each other. In various embodiments, the first and second receptacle connectors 112, 122 are card edge connectors; however, other types of electrical connectors may be used in alternative embodiments.

Figure 2:
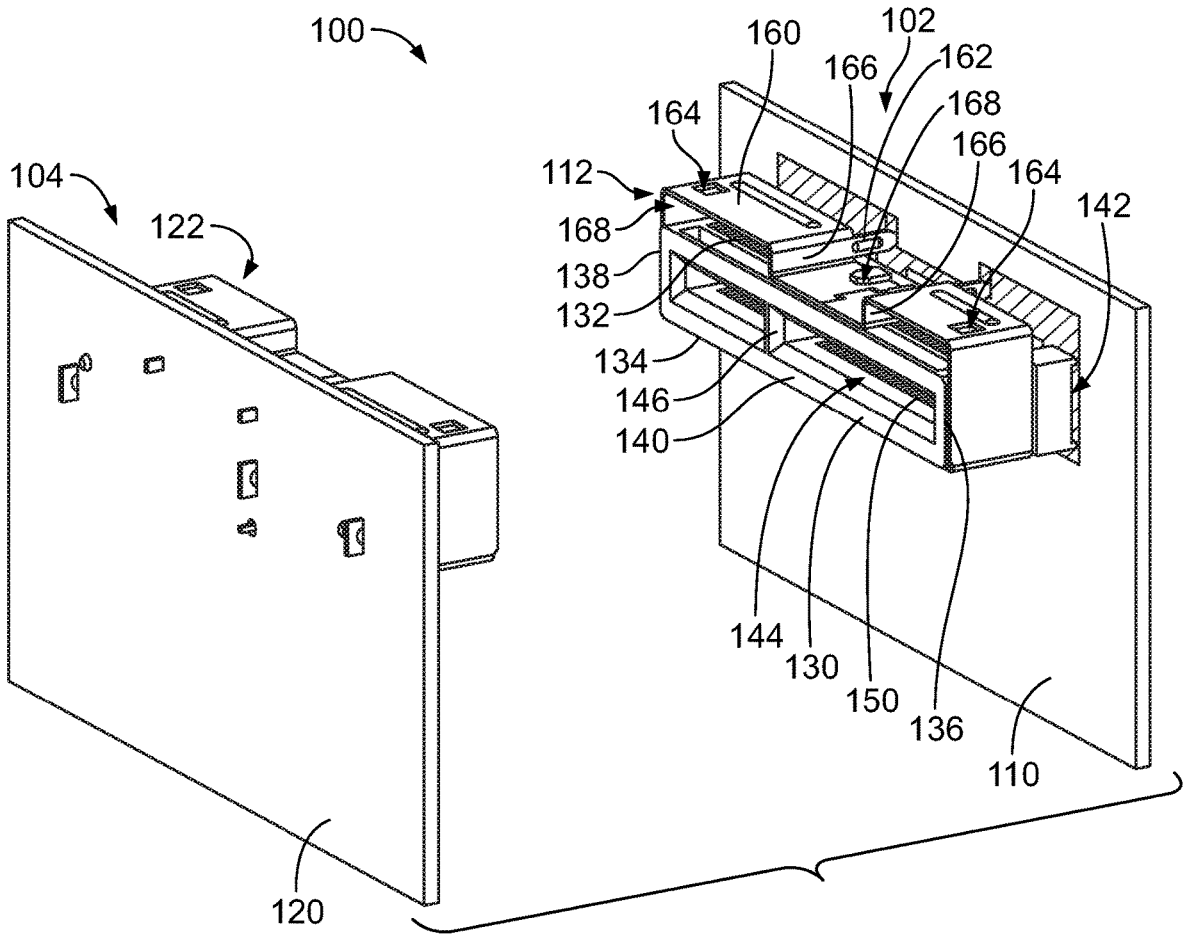
FIG. 2 illustrates a portion of the electrical connector system in accordance with an exemplary embodiment.

FIG. 2 illustrates a portion of the electrical connector system 100 showing the first electrical component 102 and the second electrical component 104. The flex jumper assembly 200 (shown in FIG. 1) is removed for clarity to illustrate the receptacle connectors 112, 122 of the electrical components 102, 104. The description herein relates to the first receptacle connector 112; however, the second receptacle connector 122 may include similar or identical components.

The receptacle connector 112 includes a receptacle connector housing 130 mounted to the circuit board 110. The receptacle connector housing 130 includes a top wall 132, a bottom wall 134, a first side wall 136, and a second side wall 138. The receptacle connector housing 130 includes a mating end 140 and a mounting end 142. The mounting end 142 is mounted to the circuit board 110. The mating end 140 is configured to be mated with the flex jumper assembly 200. In the illustrated embodiment, the mating end 140 is opposite the mounting end 142. However, other orientations are possible in alternative embodiments. For example, the receptacle connector housing 130 may be a right angle housing having the mating end 140 perpendicular to the mounting end 142.

In an exemplary embodiment, the receptacle connector housing 130 includes a card slot 144 at the mating end 140. The card slot 144 is configured to receive a paddle card of the flex jumper assembly 200. The walls of the receptacle connector housing 130 surround the card slot 144. In an exemplary embodiment, the receptacle connector housing 130 includes a keying wall 146 extending across the card slot 144. The keying wall 146 may be offset from a center position of the card slot 144 to provide keyed mating with the flex jumper assembly 200.

The receptacle connector 112 includes receptacle contacts 150 held by the receptacle connector housing 130. The receptacle contacts 150 extend into the card slot 144 for mating with the flex jumper assembly 200. For example, the receptacle contacts 150 may include spring beams at the mating ends of the receptacle contacts 150 arranged within the card slot 144 for mating with the flex jumper assembly 200. In various embodiments, the receptacle contacts 150 may be provided along the top and the bottom of the card slot 144 in two different rows. The receptacle contacts 150 are terminated to the circuit board 110. For example, ends of the receptacle contacts 150 may be surface mounted to the circuit board 110. Alternatively, the ends of the receptacle contacts 150 may be press-fit into the circuit board 110.

In an exemplary embodiment, the receptacle connector 112 includes a shroud 160 surrounding at least a portion of the receptacle connector housing 130. Optionally, the shroud 160 may be a metal shroud. The shroud 160 may provide electrical shielding for the receptacle connector housing 130. For example, the shroud 160 may be electrically grounded to the circuit board 110. In various embodiments, the shroud 160 is a stamped and formed metal structure. In an exemplary embodiment, the shroud 160 provide mechanical support for the receptacle connector 112 with the circuit board 110. For example, the shroud 160 is mechanically coupled to the circuit board 110 to provide strain relief for the receptacle connector housing 130 and/or the receptacle contacts 150. In various embodiments, the shroud 160 includes mounting tabs 162 coupled to the circuit board 110. The mounting tabs 162 may be press-fit into openings in the circuit board 110. Additionally or alternatively, the mounting tabs 162 may be soldered to the circuit board 110.

In an exemplary embodiment, the shroud 160 includes latch openings 164 configured to receive latching features of the flex jumper assembly 200. For example, the latches of the plug connector 204 may be secured to the shroud 160 at the latch openings 164. Other types of latching features may be provided in alternative embodiments to secure the plug connector 204 to the receptacle connector 112.

In an exemplary embodiment, the shroud 160 includes locating walls 166 to locate the plug connector 204 relative to the receptacle connector 112. The locating walls 166 may guide mating of the plug connector 204 with the receptacle connector 112. The locating walls 166 may be used to orient the plug connector 204 relative to the receptacle connector 112 in a straight orientation. For example, the locating walls 166 may prevent skewed mating of the plug connector 204 with the receptacle connector 112 at an angle. In the illustrated embodiment, the locating walls 166 extend along pockets 168 that receive locating features of the plug connector 204. In the illustrated embodiment, the receptacle connector 112 includes both internal pockets and external pockets that receive corresponding locating features of the plug connector 204.

Figure 3:
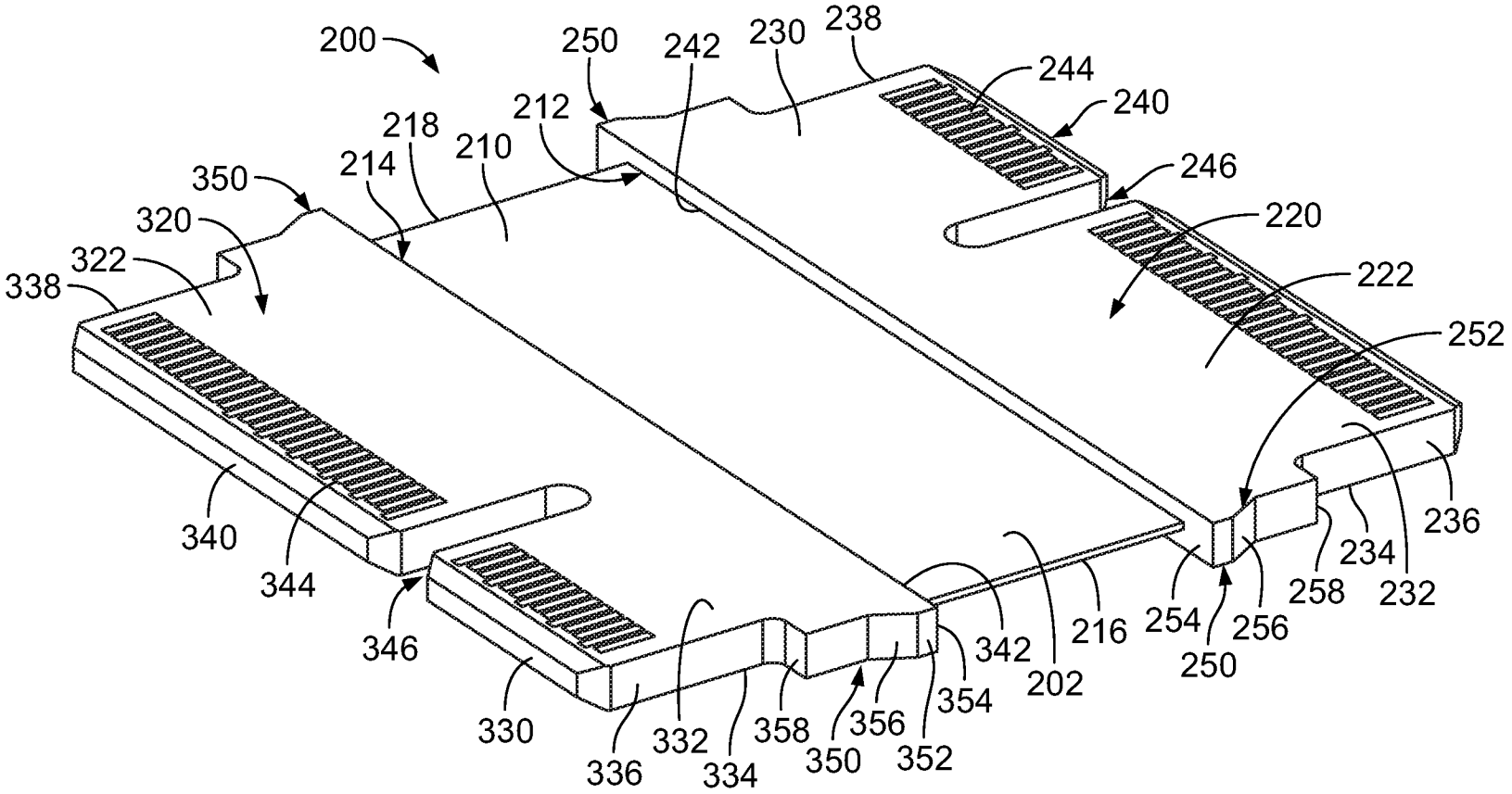
FIG. 3 illustrates a portion of the flex jumper assembly in accordance with an exemplary embodiment.

FIG. 3 illustrates a portion of the flex jumper assembly 200 in accordance with an exemplary embodiment. FIG. 3 shows a circuit assembly 208 of the flex jumper assembly 200. In an exemplary embodiment, the circuit assembly 208 is a rigid flex circuit including the flex circuit 202, a first rigid circuit 220, and a second rigid circuit 320. The flex circuit 202 extends between the rigid circuits 220, 320. In an exemplary embodiment, the first rigid circuit 220 is a first paddle card 222 and the second rigid circuit 320 is a second paddle card 322. In various embodiments, the flex circuit 202 and the rigid circuits 220, 320 are manufactured during one or more circuit board manufacturing processes. The flex circuit 202 eliminates the need for terminating separate, individual cables to the first and second paddle cards 222, 322, and thus eliminates the assembly cost of terminating the separate, individual cables to the first and second paddle cards 222, 322.

The first paddle card 222 includes a first rigid substrate 230 having an upper surface 232 and a lower surface 234. The first paddle card 222 includes side edges 236, 238 extending between a first mating end 240 and a first flex circuit end 242 opposite the first mating end 240. The first rigid substrate 230 may include multiple layers. The first paddle card 222 includes circuits between the flex circuit 202 and contacts 244 of the first paddle card 222. In various embodiments, the contacts 244 define upper contacts on the upper surface 232 and lower contacts on the lower surface 234. The contacts 244 are provided proximate to the first mating end 240. The contacts 244 are configured to be electrically connected to corresponding receptacle contacts 150 (shown in FIG. 2). In an exemplary embodiment, the first rigid substrate 230 includes a keying slot 246 open at the first mating end 240 configured to mate with the keying wall 146 (shown in FIG. 2) to orient the first paddle card 222 relative to the receptacle connector 112.

In an exemplary embodiment, the first paddle card 222 includes securing features 250 along the side edges 236, 238 for securing the first paddle card 222 in a corresponding plug housing. In an exemplary embodiment, the side edges 236, 238 are nonplanar to define the securing features 250. For example, the securing features 250 may be protrusions or other features extending outward from the side edges 236, 238. Alternatively, the securing features 250 may be notches are cutouts formed along the side edges 236, 238. In various embodiments, the securing feature 250 includes a latching element 252. Each latching element 252 includes a securing surface 254. Optionally, the securing surface 254 may be provided at the first flex circuit end 242. Optionally, the latching element 252 may include a ramp surface 256. In an exemplary embodiment, the first paddle card 222 includes stop shoulders 258 along the side edges 236, 238. The stop shoulders 258 are configured to locate the first paddle card 222 in the corresponding plug housing.

The second paddle card 322 includes a second rigid substrate 330 having an upper surface 332 and a lower surface 334. The second paddle card 322 includes side edges 336, 338 extending between a second mating end 340 and a second flex circuit and 342 opposite the second mating end 340. The second rigid substrate 330 may include multiple layers. The second paddle card 322 includes circuits between the flex circuit 202 and contacts 344 of the second paddle card 322. In various embodiments, the contacts 344 define upper contacts on the upper surface 332 and lower contacts on the lower surface 334. The contacts 344 are provided proximate to the second mating end 340. The contacts 344 are configured to be electrically connected to corresponding receptacle contacts 150 (shown in FIG. 2). In an exemplary embodiment, the second rigid substrate 330 includes a keying slot 346 open at the second mating end 340 configured to mate with the receptacle connector 122 (shown in FIG. 1).

In an exemplary embodiment, the second paddle card 322 includes securing features 350 along the side edges 336, 338 for securing the second paddle card 322 in a corresponding plug housing. In an exemplary embodiment, the side edges 336, 338 are nonplanar to define the securing features 350. For example, the securing features 350 may be protrusions or other features extending outward from the side edges 336, 338. Alternatively, the securing features 350 may be notches are cutouts formed along the side edges 336, 338. In various embodiments, the securing feature 350 include latches 352. Each latch 352 includes a securing surface 354. Optionally, the securing surface 354 may be provided at the second flex circuit and 342. Optionally, the latch 352 may include a ramp surface 356. In an exemplary embodiment, the second paddle card 322 includes stop shoulders 358 along the side edges 336, 338. The stop shoulders 358 are configured to locate the second paddle card 322 in the corresponding plug housing.

The flex circuit 202 includes a flexible substrate 210 extending between a first end 212 and a second end 214. The first end 212 extends into the first paddle card 222. The second end 214 extends into the second paddle card 322. The flex circuit 202 includes a plurality of circuits electrically connected to the circuits of the first and second paddle card 322, 322 the circuits are electrically connected to the contacts 244 of the first paddle card 222 and the contacts 344 of the second paddle card 322. The flexible substrate 210 includes side edges 216, 218 extending between the first and second ends 212, 214. In various embodiments, the flexible substrate 210 may have a width between the side edges 216, 218 approximately equal to widths of the rigid substrates 230, 330 between the side edges 236, 238 and the side edges 336, 338, respectively. The flexible substrate 210 is relatively thin between upper and lower surfaces of the flexible substrate 210 allowing the flexible substrate 210 flex and move along its length. In the illustrated embodiment, the flexible substrate 210 is thinner than the rigid substrates 230, 330 between the upper and lower surfaces. The flexible substrate 210 may be approximately centered along the first flex circuit end 242 and approximately centered along the second flex circuit end 342.

Figure 4:
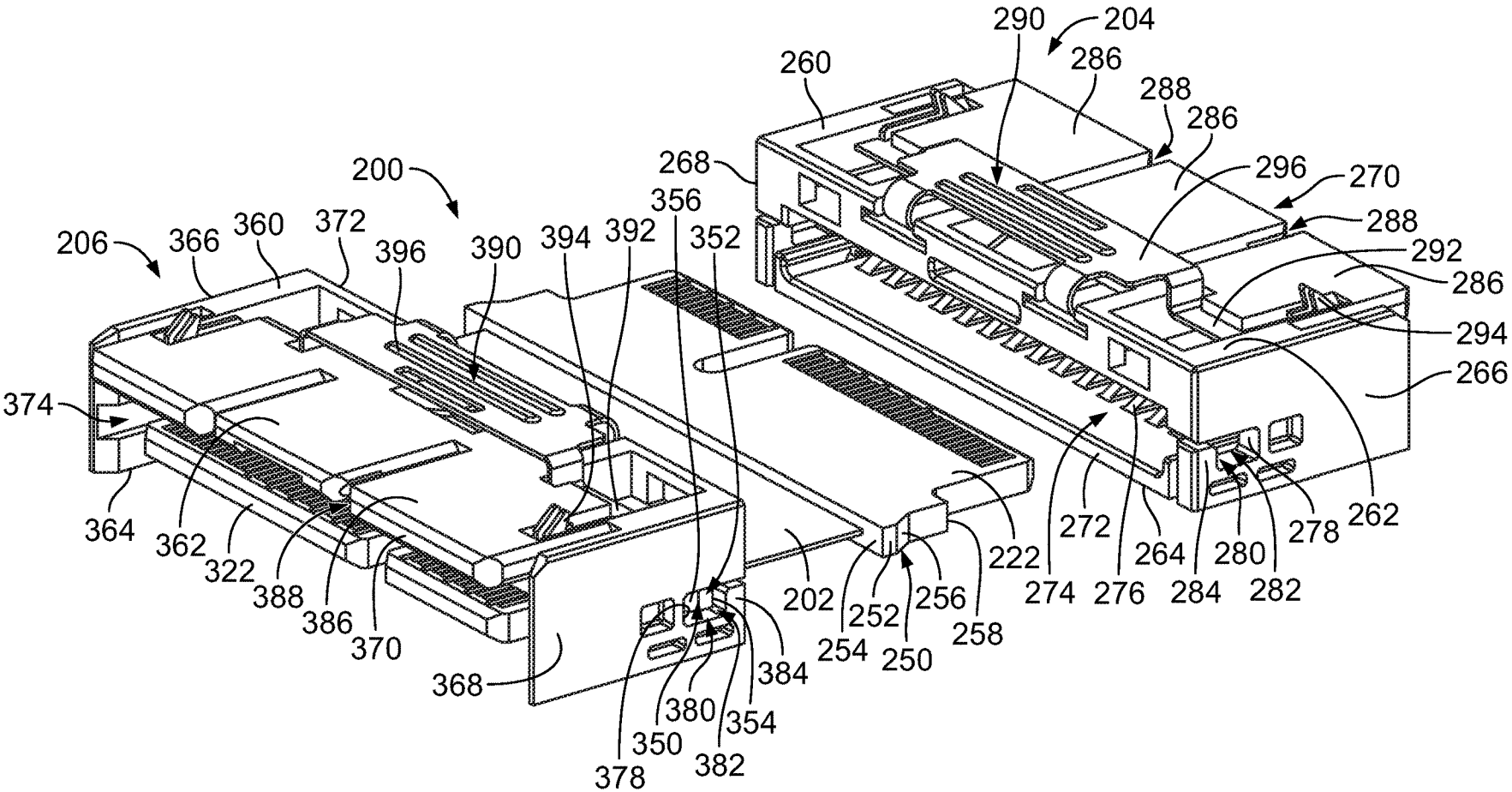
FIG. 4 is a rear perspective view of the flex jumper assembly in accordance with an exemplary embodiment.
Figure 5:
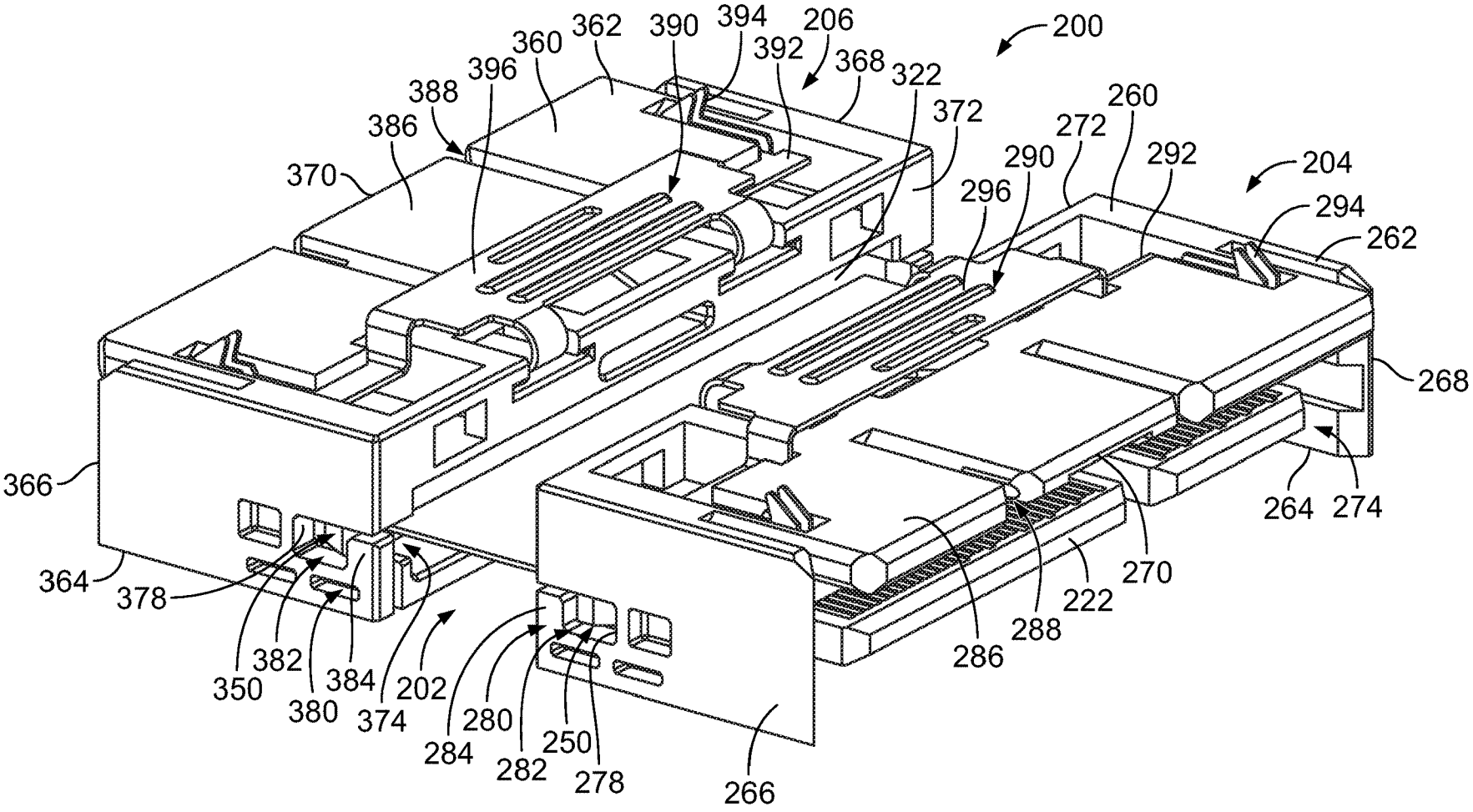
FIG. 5 is a front perspective view of the flex jumper assembly in accordance with an exemplary embodiment.

FIG. 4 is a rear perspective view of the flex jumper assembly 200 in accordance with an exemplary embodiment. FIG. 5 is a front perspective view of the flex jumper assembly 200 in accordance with an exemplary embodiment. FIG. 4 shows the flex jumper assembly 200 partially assembled. FIG. 5 shows the flex jumper assembly 200 fully assembled.

The flex circuit 202 extends between the first plug connector 204 and the second plug connector 206. The first plug connector 204 includes the first paddle card 222 and a first plug housing 260. The first paddle card 222 is received in the first plug housing 260. The second plug connector 206 includes the second paddle card 322 and a second plug housing 360. The second paddle card 322 is received in the second plug housing 360. The flex circuit 202 allows relative movement of the first and second plug housings 260, 360, such as for alignment of the first and second plug housings 260, 360 with the first and second receptacle connectors 112, 122 (shown in FIG. 1), respectively.

The first plug housing 260 includes a top wall 262, a bottom wall 264, a first side wall 266, and a second side wall 268. The first plug housing 260 extends between a mating end 270 and a card end 272. The mating end 270 is configured to be mated with the first receptacle connector 112. The card end 272 is configured to receive the first paddle card 222. In an exemplary embodiment, the first plug housing 260 includes a first cavity 274 that receives the first paddle card 222. The first cavity 274 is surrounded by the walls of the first plug housing 260. In an exemplary embodiment, the first cavity 274 is open at the card end 272 to receive the first paddle card 222 therein. In an exemplary embodiment, the first plug housing 260 includes card supports 276 to locate and support the first paddle card 222 in the first cavity 274. In an exemplary embodiment, the first plug housing 260 includes a stop wall 278 extending into the first cavity 274. The first paddle card 222 may be loaded into the first cavity 274 until the stop shoulder 258 engages the stop wall 278. The stop wall 278 limits loading of the first paddle card 222 into the first cavity 274.

In an exemplary embodiment, the first plug housing 260 includes housing securing features 280 used to secure the first paddle card 222 in the first plug housing 260. In the illustrated embodiment, the housing securing features 280 include openings 282 that receive the securing features 250 of the first paddle card 222. For example, the openings 282 receive the latching elements 252 of the first paddle card 222. The housing securing features 280 may be deflectable to allow the latching elements 252 to slide into the openings 282. For example, the housing securing features 280 may be deflectable outward as the ramp surfaces 256 are loaded into the first plug housing 260. Once the latching elements 252 are received in the openings 282, the housing securing features 280 may snap closed behind the securing surfaces 254. As such, the housing securing features 280 are snappably coupled to the securing features 250 of the first paddle card 222. The housing securing features 280 include retaining tabs 284 located behind the securing surfaces 254 of the securing features 250 of the first paddle card 222 to lock the securing features 250 in the openings 282. The first paddle card 222 is captured in the first cavity 274 by the stop wall 278 and the retaining tab 284. The stop wall 278 and the retaining tab 284 limit front to rear movement of the first paddle card 222 in the first cavity 274. In an exemplary embodiment, the retaining tabs 284 are deflectable to release the securing features 250 from the first plug housing 260.

In an exemplary embodiment, the first plug housing 260 includes locating features configured to locate the first plug connector 204 relative to the first receptacle connector 112. In the illustrated embodiment, the locating features include locating tabs 286 separated by slots 288. The locating tabs 286 are provided along the top wall 262, such as at the mating end 270. In an exemplary embodiment, the locating tabs 286 are configured to interface with the locating walls 266 of the shroud 160 (shown in FIG. 2) to orient the first plug connector 204 relative to the first receptacle connector 112. In the illustrated embodiment, three locating tabs 286 are provided along the top wall 262 separated by corresponding slots 288. The first plug housing 260 may additionally or alternatively include locating tabs 286 along the side walls 266, 268 and/or along the bottom wall 264.

In an exemplary embodiment, the first plug connector 204 includes a latch 290 coupled to the first plug housing 260. In the illustrated embodiment, the latch 290 is provided at the top wall 262 of the first plug housing 260. Other locations are possible in alternative embodiments. The latch 290 is configured to be latchably coupled to the first receptacle connector 112. For example, the latch 290 may be received in the latch opening 164 in the shroud 160 (shown in FIG. 2). The latch 290 includes latching arms 292 having latch fingers 294 at the distal ends of the latching arms 292. The latch fingers 294 are configured to be received in the latch openings 164. The latch 290 includes a latch release 296 to release the latching arms 292 and the latch fingers 294. For example, the latch release 296 may be a pushbutton style latch release. Other types of latch releases may be used in alternative embodiments, such as a pull tether.

The second plug housing 360 includes a top wall 362, a bottom wall 364, a first side wall 366, and a second side wall 368. The second plug housing 360 extends between a mating end 370 and a card end 372. The mating end 370 is configured to be mated with the second receptacle connector 122. The card end 372 is configured to receive the second paddle card 322. In an exemplary embodiment, the second plug housing 360 includes a second cavity 374 that receives the second paddle card 322. The second cavity 374 is surrounded by the walls of the second plug housing 360. In an exemplary embodiment, the second cavity 374 is open at the card end 372 to receive the second paddle card 322 therein. In an exemplary embodiment, the second plug housing 360 includes card supports 376 to locate and support the second paddle card 322 in the second cavity 374. In an exemplary embodiment, the second plug housing 360 includes a stop wall 378 extending into the second cavity 374. The second paddle card 322 may be loaded into the second cavity 374 until the stop shoulder 358 engages the stop wall 378. The stop wall 378 limits loading of the second paddle card 322 into the second cavity 374.

In an exemplary embodiment, the second plug housing 360 includes housing securing features 380 used to secure the second paddle card 322 in the second plug housing 360. In the illustrated embodiment, the housing securing features 380 include openings 382 that receive the securing features 350 of the second paddle card 322. For example, the openings 382 receive the latches 352 of the second paddle card 322. The housing securing features 380 may be deflectable to allow the latches 352 to slide into the openings 382. For example, the housing securing features 380 may be deflectable outward as the ramp surfaces 356 are loaded into the second plug housing 360. Once the latches 352 are received in the openings 382, the housing securing features 380 may snap closed behind the securing surfaces 354. As such, the housing securing features 380 are snappably coupled to the securing features 350 of the second paddle card 322. The housing securing features 380 include retaining tabs 384 located behind the securing surfaces 354 of the securing features 350 to lock the securing features 350 in the openings 382. The second paddle card 322 is captured in the second cavity 374 by the stop wall 378 and the retaining tab 384. The stop wall 378 and the retaining tab 384 limit front to rear movement of the second paddle card 322 in the second cavity 374. In an exemplary embodiment, the retaining tabs 384 are deflectable to release the securing features 350 from the second plug housing 360.

In an exemplary embodiment, the second plug housing 360 includes locating features configured to locate the second plug connector 206 relative to the second receptacle connector 122. In the illustrated embodiment, the locating features include locating tabs 386 separated by slots 388. The locating tabs 386 are provided along the top wall 362, such as at the mating end 370. In an exemplary embodiment, the locating tabs 386 are configured to interface with the locating walls 366 of the shroud 160 (shown in FIG. 3) to orient the second plug connector 206 relative to the second receptacle connector 122. In the illustrated embodiment, three locating tabs 386 are provided along the top wall 362 separated by corresponding slots 388. The second plug housing 360 may additionally or alternatively include locating tabs 386 along the side walls 366, 368 and/or along the bottom wall 364.

In an exemplary embodiment, the second plug connector 206 includes a latch 390 coupled to the second plug housing 360. In the illustrated embodiment, the latch 390 is provided at the top wall 362 of the second plug housing 360. Other locations are possible in alternative embodiments. The latch 390 is configured to be latchably coupled to the second receptacle connector 122. For example, the latch 390 may be received in the latch opening 164 in the shroud 160 (shown in FIG. 3). The latch 390 includes latching arms 392 having latch fingers 394 at the distal ends of the latching arms 392. The latch fingers 394 are configured to be received in the latch openings 164. The latch 390 includes a latch release 396 to release the latching arms 392 and the latch fingers 394. For example, the latch release 396 may be a pushbutton style latch release. Other types of latch releases may be used in alternative embodiments, such as a pull tether.

Figure 6:
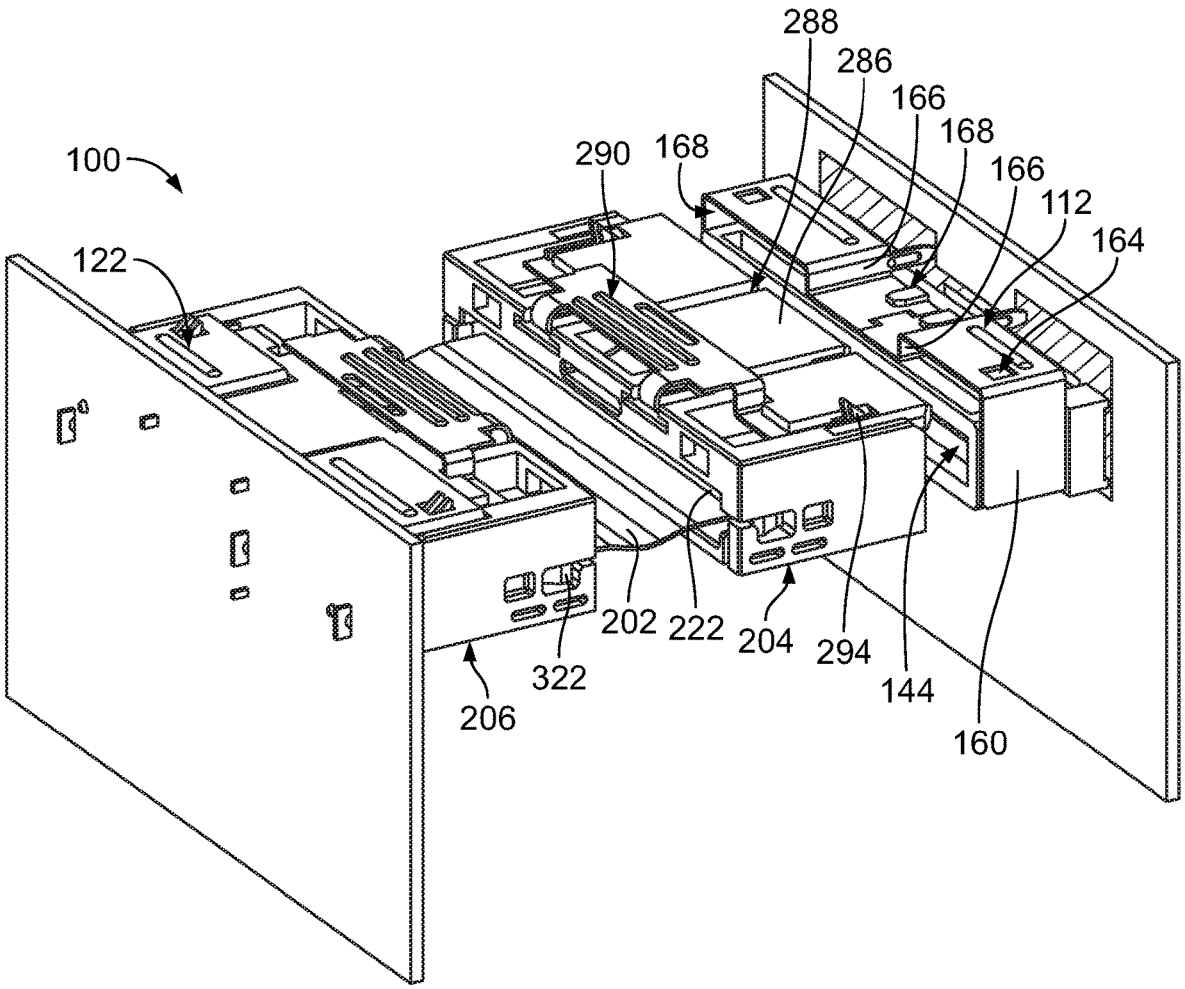
FIG. 6 illustrates the electrical connector system in accordance with an exemplary embodiment.

FIG. 6 illustrates the electrical connector system 100 showing the first power connector 204 poised for coupling to the first receptacle connector 112 and showing the second power connector 206 coupled to the second receptacle connector 122. FIG. 6 illustrates the electrical connector system 100 coupled to the second receptacle connector 122. The flex circuit 202 creates the electrical connection between the first and second paddle cards 222, 322 and eliminates the need for terminating separate, individual cables to the first and second paddle cards 222, 322. The flex circuit 202 thus eliminates assembly cost associated with terminating separate, individual cables to the first and second paddle cards 222, 322. The flex circuit 202 is flexible to allow the first plug connector 204 to align with the first receptacle connector 112. The flex circuit 202 is flexible to allow the first plug connector 204 to move upward, to move downward, to move forward, to move rearward, to move side to side, and two twisted or rotated to align the first plug connector 204 with the first receptacle connector 112. A length of the flex circuit 202 may be appropriately selected based on the spacing between the first and second receptacle connectors 112, 122.

During mating, the first paddle card 222 is aligned with the card slot 144. The first plug connector 204 is mated to the first receptacle connector 112 in the mating direction. The first paddle card 222 is loaded into the card slot 144. The locating tabs 286 are received in corresponding pockets 168 in the shroud 160. For example, two of the locating tabs 286 may be received in the interior pockets 168 and the middle locating tab 286 may be received in the exterior pocket 168. The locating walls 166 engage the locating tabs 286 to position the first plug connector 204 relative to the first receptacle connector 112. For example, the locating walls 166 may be received in the slots 288 to engage side edges of the locating tabs 286. In an exemplary embodiment, the locating tabs 286 are aligned with and the pockets 168 before the first paddle card 222 is received in the card slot 144. As such, the locating tabs 286 may be used to orient and position the first paddle card 222 relative to the card slot 144 prior to the first paddle card 222 being loaded into the card slot 144. As such, risk of damage to the receptacle contacts 150 and/or the contacts 244 of the first paddle card 222 is reduced. During mating, the latch 290 is latchably coupled to the shroud 160. For example, the latch fingers 294 configured to be received in the latch openings 164 latchably couple the first plug connector 204 to the first receptacle connector 112 to thereby enable an efficient short-range connection between the first circuit board 110 and the second circuit board 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector assembly comprising:

a first plug connector including a first plug housing having a top wall, a bottom wall, a first side wall, and a second side wall forming a first cavity, the first and second side walls of the first plug housing including a first housing securing feature, the first plug connector including a first latch at the top wall of the first plug housing, the first latch configured to be latchably coupled to a first receptacle connector a second plug connector including a second plug housing having a top wall, a bottom wall, a first side wall, and a second side wall forming a second cavity, the first and second side walls of the second plug housing including a second housing securing feature, the second plug connector including a second latch at the top wall of the second plug housing, the second latch configured to be latchably coupled to a second receptacle connector; and a flex jumper assembly coupled between the first plug connector and the second plug connector, the flex jumper assembly including a first paddle card, a second paddle card and a flex circuit extending between the first paddle card and the second paddle card, the first paddle card having a first rigid substrate including a first mating end and a side edge extending from the first mating end to a first flex circuit end, the first paddle card including first contacts at the first mating end, the first rigid substrate including a first plug connector securing feature at the side edge, the first paddle card being received in the first cavity, the first plug connector securing feature engaging the first housing securing feature to retain the first paddle card in the first plug housing, the second paddle card having a second rigid substrate including a second mating end and a side edge extending from the second mating end to a second flex circuit end, the second paddle card including second contacts at the second mating end, the second rigid substrate including a second plug connector securing feature at the side edge, the second paddle card being received in the second cavity, the second plug connector securing feature engaging the second housing securing feature to retain the second paddle card in the second plug housing, the flex circuit extending between the first flex circuit end and the second flex circuit end, the flex circuit being flexible between the first and second paddle cards.

2. The plug connector assembly of claim 1, wherein the first plug connector securing feature is snapped into the first plug housing to retain the first paddle card in the first plug housing, and wherein the second plug connector securing feature of the second paddle card is snapped into the second plug housing to retain the second paddle card in the second plug housing.

3. The plug connector assembly of claim 1, wherein the side edge of the first paddle card is nonplanar to define the first plug connector securing feature, and wherein the side edge of the second paddle card is nonplanar to define the second plug connector securing feature.

4. The plug connector assembly of claim 1, wherein the first plug connector securing feature includes a latching feature latchably coupled to the first housing securing feature, and wherein the second plug connector securing feature includes a latching feature latchably coupled to the second housing securing feature.

5. The plug connector assembly of claim 1, wherein the first plug connector securing feature is located proximate to the first flex circuit end, and wherein the second plug connector securing feature is located proximate to the second flex circuit end.

6. The plug connector assembly of claim 1, wherein the flex circuit has a length between the first paddle card and the second paddle card less than 150 mm.

7. The plug connector assembly of claim 1, wherein the first housing securing feature includes an opening, the first plug connector securing feature including a latching element received in the opening of the first plug housing, and wherein the second housing securing feature includes an opening, the second plug connector securing feature includes a latching element received in the opening of the second plug housing.

8. The plug connector assembly of claim 1, wherein the first plug connector includes a first plug mating end at a front of the first plug housing, the first plug mating end configured to be pluggably coupled to the first receptacle connector, and wherein the second plug connector includes a second plug mating end at a front of the second plug housing, the second plug mating end configured to be pluggably coupled to the second receptacle connector.

9. The plug connector assembly of claim 1, wherein the first plug housing includes a first card support in the first cavity, the first card support locating the first paddle card in the first cavity, and wherein the second plug housing includes a second card support in the second cavity, the second card support locating the second paddle card in the second cavity.

10. An electrical connector system comprising:

a first receptacle connector having a first receptacle connector housing mounted to a first host circuit board, the first receptacle connector housing having a card slot, the first receptacle connector including first receptacle contacts held by the first receptacle connector housing at the card slot, the first receptacle contacts being electrically connected to the first host circuit board;

a second receptacle connector having a second receptacle connector housing mounted to a second host circuit board, the second receptacle connector housing having a card slot, the second receptacle connector including second receptacle contacts held by the second receptacle connector housing at the card slot, the second receptacle contacts being electrically connected to the second host circuit board; and a plug connector assembly coupled between the first and second receptacle connectors, the plug connector assembly including a first plug connector, a second plug connector, and a flex jumper assembly coupled between the first plug connector and the second plug connector, the first plug connector including a first plug housing coupled to the first receptacle connector housing, the first plug housing having a top wall, a bottom wall, a first side wall, and a second side wall forming a first cavity, the first and second side walls of the first plug housing including a first housing securing feature, the second plug connector including a second plug housing coupled to the second receptacle connector housing, the second plug housing having a top wall, a bottom wall, a first side wall, and a second side wall forming a second cavity, the first and second side walls of the second plug housing including a second housing securing feature, the flex jumper assembly including a first paddle card, a second paddle card and a flex circuit extending between the first paddle card and the second paddle card, the first paddle card having a first rigid substrate including a first mating end and a side edge extending from the first mating end to a first flex circuit end, the first mating end being received in the card slot of the first receptacle connector housing, the first paddle card including first contacts at the first mating end, the first rigid substrate including a first plug connector securing feature at the side edge, the first paddle card being received in the first cavity, the first plug connector securing feature engaging the first housing securing feature to retain the first paddle card in the first plug housing, the second paddle card having a second rigid substrate including a second mating end and a side edge extending from the second mating end to a second flex circuit end, the second mating end being received in the card slot of the second receptacle connector housing, the second paddle card including second contacts at the second mating end, the second rigid substrate including a second plug connector securing feature at the side edge, the second paddle card being received in the second cavity, the second plug connector securing feature engaging the second housing securing feature to retain the second paddle card in the second plug housing, the flex circuit extending between the first flex circuit end and the second flex circuit end, the flex circuit being flexible between the first and second paddle cards.

11. The electrical connector system of claim 10, wherein the first plug connector securing feature is snapped into the first plug housing to retain the first paddle card in the first plug housing, and wherein the second plug connector securing feature of the second paddle card is snapped into the second plug housing to retain the second paddle card in the second plug housing.

12. The electrical connector system of claim 10, wherein the side edge of the first paddle card is nonplanar to define the first plug connector securing feature, and wherein the side edge of the second paddle card is nonplanar to define the second plug connector securing feature.

13. The electrical connector system of claim 10, wherein the first housing securing feature includes an opening, the first plug connector securing feature including a latching element received in the opening of the first plug housing, and wherein the second housing securing feature includes an opening, the second plug connector securing feature includes a latching element received in the opening of the second plug housing.

14. The electrical connector system of claim 10, wherein the first plug connector includes a first latch at the top wall of the first plug housing, the first latch being latchably coupled to the first receptacle connector, and wherein the second plug connector includes a second latch at the top wall of the second plug housing, the second latch being latchably coupled to the second receptacle connector.

15. A flex jumper assembly comprising:

a first paddle card having a first rigid substrate including an upper surface and a lower surface, the first paddle card having a first mating end, the first paddle card including side edges extending from the first mating end to a first flex circuit end opposite the first mating end, the first paddle card including upper contacts on the upper surface at the first mating end, the first paddle card including lower contacts on the lower surface at the first mating end, the first mating end defining a card edge configured to be plugged into a first receptacle connector to mate the upper and lower contacts with first receptacle contacts of the first receptacle connector, the first rigid substrate including securing features at the side edges configured to engage a first plug housing to retain the first paddle card in the first plug housing;

a second paddle card having a second rigid substrate including an upper surface and a lower surface, the second paddle card having a second mating end, the second paddle card including side edges extending from the second mating end to a second flex circuit end opposite the second mating end, the second paddle card including upper contacts on the upper surface at the second mating end, the second paddle card including lower contacts on the lower surface at the second mating end, the second mating end defining a card edge configured to be plugged into a second receptacle connector to mate the upper and lower contacts with second receptacle contacts of the second receptacle connector, the second rigid substrate including securing features at the side edges configured to engage a second plug housing to retain the second paddle card in the second plug housing; and a flex circuit extending between the first flex circuit end of the first paddle card and the second flex circuit end of the second paddle card, the flex circuit being flexible between the first and second paddle cards.

16. The flex jumper assembly of claim 15, wherein the securing features of the first paddle card are snapped into the first plug housing to retain the first paddle card in the first plug housing, and wherein the securing features of the second paddle card are snapped into the second plug housing to retain the second paddle card in the second plug housing.

17. The flex jumper assembly of claim 15, wherein the side edges of the first paddle card are nonplanar to define the securing features, and wherein the side edges of the second paddle card are nonplanar to define the securing features.

18. The flex jumper assembly of claim 15, wherein the securing features of the first paddle card include latching features configured to be latchably coupled to the first plug housing, and wherein the securing features of the second paddle card include latching features configured to be latchably coupled to the second plug housing.

19. The flex jumper assembly of claim 15, wherein the securing features of the first paddle card are located proximate to the first flex circuit end, and wherein the securing features of the second paddle card are located proximate to the second flex circuit end.

20. The flex jumper assembly of claim 15, wherein the flex circuit has a length between the first paddle card and the second paddle card less than 150 mm.

* * * * *